US006210560B1

(12) United States Patent
Wiehe et al.

(10) Patent No.: US 6,210,560 B1
(45) Date of Patent: Apr. 3, 2001

(54) MITIGATION OF FOULING BY THERMALLY CRACKED OILS (LAW852)

(75) Inventors: Irwin A. Wiehe, Gladstone; Glen B Brons, Phillipsburg; Linda S. Cronin, West Orange, all of NJ (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/330,692

(22) Filed: Jun. 11, 1999

(51) Int. Cl.[7] ..... C10G 79/04; C10G 9/16

(52) U.S. Cl. ..... 208/48 AA; 208/48 R; 208/130; 208/131; 585/648

(58) Field of Search ..... 208/48 R, 48 AA, 208/127, 131, 130; 585/648

(56) References Cited

U.S. PATENT DOCUMENTS 3,607,960 * 9/1971 Button et al. ..... 260/672 NC
3,671,424 * 6/1972 Saxton ..... 208/127
4,024,050 * 5/1977 Shell et al. ..... 208/48 AA
4,176,045 * 11/1979 Leftin et al. ..... 208/48 R
4,389,302 * 6/1983 Garwin et al. ..... 208/86
4,397,740 * 8/1983 Koontz ..... 208/48 Q
4,454,023 * 6/1984 Lutz ..... 208/96
4,664,784 * 5/1987 Harandi ..... 208/354
5,258,113 * 11/1993 Edgerton et al. ..... 208/48 AA
5,460,712 * 10/1995 Lemke ..... 208/48 AA
5,463,159 * 10/1995 Callejas et al. ..... 585/648
5,567,305 * 10/1996 Jo ..... 208/48 R
5,820,747 * 10/1998 Lenglet et al. ..... 208/130

* cited by examiner

*Primary Examiner*—Bekir L. Yildirim
(74) *Attorney, Agent, or Firm*—Ronald D. Hantman

(57) ABSTRACT

The present invention is a method for mitigating the fouling from thermally cracked oils by minimizing the residence time at the temperature when the fouling is highest.

19 Claims, 1 Drawing Sheet

FLEXICOKING Unit Fractionator
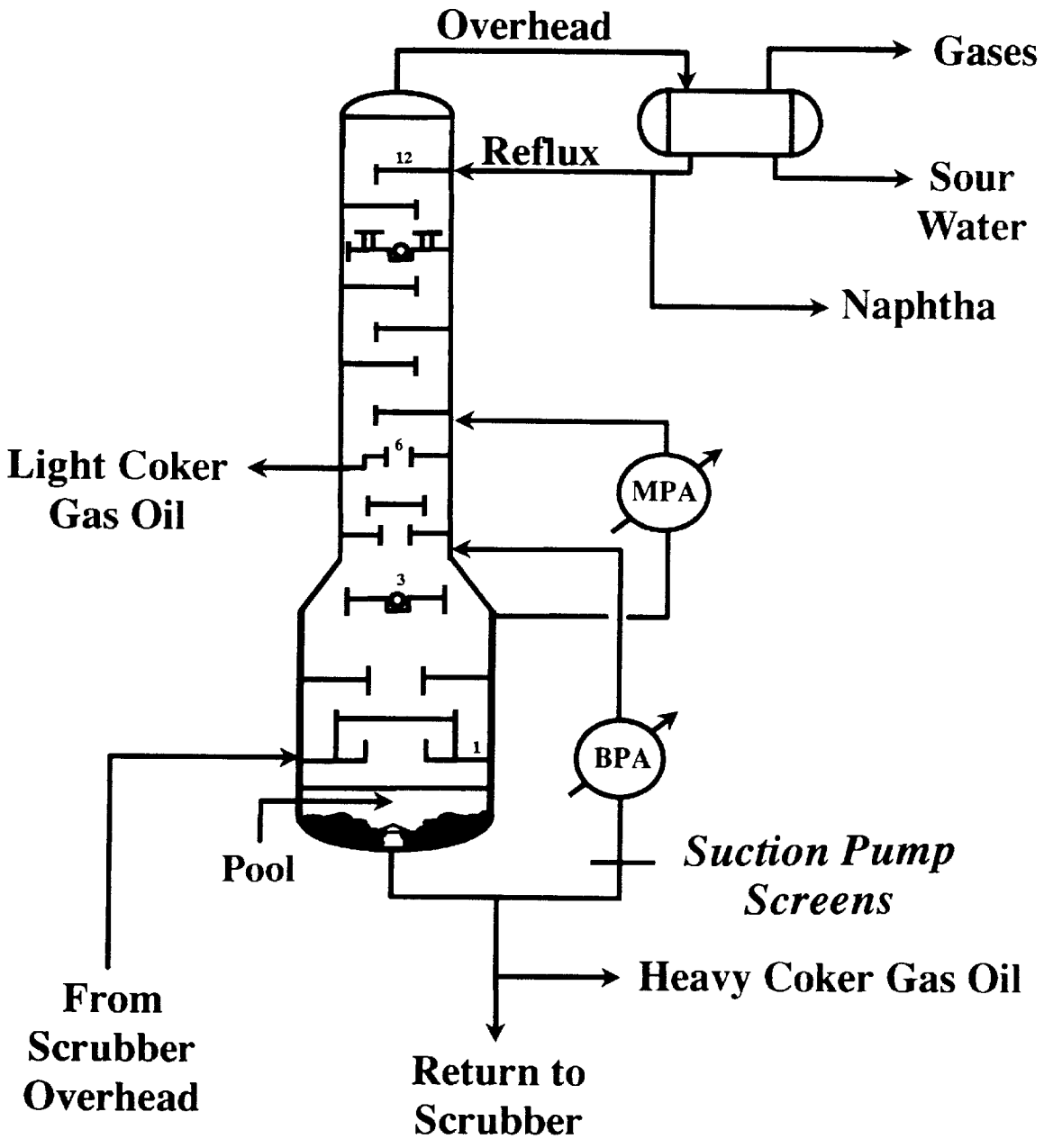

MITIGATION OF FOULING BY THERMALLY CRACKED OILS (LAW852)

BACKGROUND OF THE PRESENT INVENTION

The present invention relates to a method for reducing the tendency of thermal cracked oils to form solids that coat and plug process equipment. This method consists of reducing the time that the thermally cracked oil spends in the temperature range of 450 to 615° F. (232 to 324° C.), particularly 500 to 580° F. (260 to 304° C.). This is often most conveniently achieved by raising the temperature in the part of the process of highest residence time above 580° F. and preferably higher than 615° F.

It is well known that during the refining of petroleum oils that when the oil has been thermally cracked, the oil has a tendency to form carbonaceous, insoluble solids that coat and plug process equipment. The deposition of solids on process equipment is called fouling and the solids are called foulant. Example thermal cracking processes in a refinery include delayed coking, Fluid Coking, flexicoking, visbreaking, and gas oil thermal cracking. Examples of process equipment downstream of these thermal cracking processes are heat exchangers, reboilers, fractionators, and hydrotreater reactors. Often the carbonaceous solid has a puffed appearance that is called "popcorn coke". Even small amounts of carbonaceous solids deposited on the surface of process equipment can greatly reduce the efficiency of refinery process equipment by reducing heat transfer. Large amounts of carbonaceous solids can result in high-pressure drop which reduces throughput so much that the unit has to be shut down for cleaning. Not only does this result in high cleaning cost but the even higher loss in revenue when the operation of the unit is interrupted and cannot process oil.

SUMMARY OF THE INVENTION

The thermal cracking of petroleum or petroleum derived products produces high concentrations (often 0.1 to 1% but as high as 10 wt. %) of molecules that contains at least one olefin (double bonded carbons) conjugated to an aromatic or another olefin. An olefin is conjugated to another olefin when the double bond is one carbon bond away from a carbon connected to a double bond:

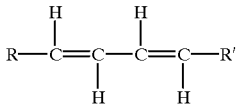

These are called diolefins or dienes and R and R' represent any hydrocarbon structure or hydrogen. Some double bonds are one carbon away from an aromatic, ϕ, that could contain one or more fused aromatic rings:

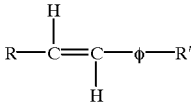

but more likely

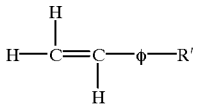

These olefins are conjugated to an aromatic. The term, conjugated olefins, includes both diolefins and olefins conjugated to an aromatic.

The concentration of conjugated olefins in an oil can most conveniently be measured by the Universal Oil Products (UOP) method number 326-82, which is well-known in the art. Although this test is said to measure the diene value, it is also known to measure olefins conjugated to aromatics. Thus, as defined here, this test measures the concentration of conjugated olefins. However, this test is not always accurate because not all conjugated olefin will be detected by the test. Examples are some cyclic dienes, such as acenapthalene. In addition some compounds that are not conjugated olefins are detected by the test, such as anthracene. (Anthracene is not typically found in petroleum derived oils.) Nevertheless, UOP method number 326-82 has been found to be accurate enough for the present invention. With the wide variety of hydrocarbon structures in petroleum oils, the conjugated olefins, when present, exist as a wide variety of structures and most are measured by this test.

According to UOP method number 326-82, the oil sample is dissolved in toluene with a known amount of maleic anhydride and refluxed for 3–4 hours. This allows the anhydride adduct to form from the reaction between maleic anhydride and conjugated olefins in the oil (illustrated in the figure below for the conjugated olefin, 2-vinyl naphthalene). Water is then added to the mixture and refluxed to convert remaining, unreacted maleic anhydride to maleic acid. The maleic acid is then isolated (water-soluble) and quantified by titration with sodium hydroxide. The amount of maleic anhydride that reacted with the oil is determined by difference.

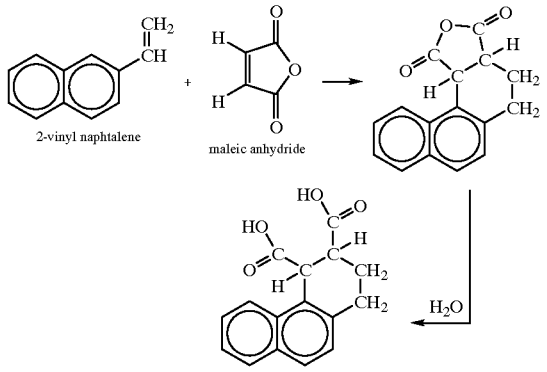

The diene value is calculated by:

$$\text{Diene Value} = \frac{(B-A)(1000\ \text{ml/l})(M)(126.9)}{100\ W} = \text{gI/100 g oil}$$

Where, A=volume of NaOH solution required to titrate sample, mL

B=volume of NaOH solution required to titrate maleic anhydride without the oil sample, mL M=molarity of the NaOH solution (mol/L)

W=weight of oil sample, grams

Without knowing the exact molecular weight of the reacted dienes in the oil, the weight concentration cannot be determined. Hence, the reported units for diene value are on a molar basis. The molecular weight of iodine, 126.9 is standardly used and the reported diene value units are grams iodine/100 grams oil.

It is known that thermally cracked oils often have high diene values as measured by UOP method number 326-82 and that these oils are the ones that are most prone to fouling. The most common mitigating action is to add low concentrations of chemicals, such as free radical traps and/or dispersants. These can be expensive and often are not effective at temperatures above 530° F. Another mitigating action commonly used is to lower the temperature. This is not always possible within the constraints of the process and depending on the initial temperature, it could actually increase the rate of fouling.

The present invention is a method for mitigating the fouling from thermally cracked petroleum oils by minimizing the residence time at the temperature when the fouling is highest. It has been found that for petroleum oils having a diene value of 4 grams iodine/100 grams oil or greater, raising the temperature of the oil in the process above 580° F. reduces fouling.

BRIEF DESCRIPTION OF THE DRAWING

The sole figure shows a schematic diagram of a Flexicoking Unit fractionator.

DESCRIPTION OF THE PREFERRED EMBODIMENT

The carbonaceous foulant from thermally cracked oils is a result of molecules containing conjugated olefins combining to form higher molecular weight molecules (polymerization). These polymerization reactions only occur at a significant rate in the temperature range of 450–615° F. and particularly in 500–580° F. Below this temperature range, the reaction rate is too slow and above this temperature range the bonds are broken thermally faster than they are formed. While it is common to lower temperature to reduce the rate of fouling by carbonaceous solids, it is a surprise that raising the temperature can mitigate such fouling.

Therefore, a preferred embodiment of the present invention is a method to reduce fouling when the diene value (UOP method number 326-82) of an oil is 4 grams iodine/100 grams oil or higher by minimizing the residence time in the temperature range of 450–615° F. and particularly in 500–580° F. One way to accomplish this is to raise the temperature in the part of the process of highest residence time to above 580° F. and preferably higher than 615° F. but lower than the temperature that thermal cracking of the oil is initiated (about 650° F. or higher). Above about 650° F., thermal cracking chemistries lead to the formation of coke. Another way is to increase the flow rate through the process equipment so that no oil has a residence time in the temperature range of 450–615° F. for longer than a minute, preferably longer than 30 seconds. This may also require one to redesign the process equipment to eliminate or minimize the presence of dead or quiescent zones where part of the oil can have residence times longer than 30 seconds, even when oil flows through the process equipment at high rates.

EXAMPLE 1

Flexicoking Unit Fractionator

A flexicoking unit was in danger of being shut down because of fractionator fouling. A flexicoking unit is described in more detail in J. H. Gary and G. E. Handwerk, 1994, *Petroleum Refining*: Marcel Dekker. The fractionator, shown in the figure, separates the volatile product from the scrubber of the flexicoking unit reactor into three liquid streams and one gas stream by distillation. Often foulant is found on the trays in the bottom pumparound (BPA) section of the fractionator. However, in this case, popcorn coke also accumulated in the bottom pool, flowed out with the oil, and plugged the pump suction strainers in the BPA circuit. The pump had to be shut down every two hours for cleaning that put the pump in danger of breaking down. If this had happened, it would have shut down the flexicoker. Lowering the bottom pool temperature from 575–580° F. to 565° F. did not help to reduce the strainer cleaning frequency. The diene value of the liquid in the bottom pump around circuit was measured to be from 7 to 9 grams iodine/100 grams oil. Then the temperature in the pool where the residence time is the greatest was raised from 565 to 590° F., the maximum temperature that it could efficiently operate. As a result, the time between pump strainer cleanings gradually increased because of a reduction in the rate of fouling. After several months, the pump strainer cleaning was reduced to the normal rate of two times per week and the fractionator continued to operate for eight months until being shut down as part of the normal planned maintenance schedule.

What is claimed is:

1. A method for mitigating the fouling of process equipment by dienes and conjugated olefins in thermally cracked petroleum oils with diene values by UOP method number 326-82 of 4 grams iodine/100 grams oil or greater comprising raising the temperature of the petroleum oil in the process to above 580° F. thereby reducing polymerization of said dienes and conjugated olefins.

2. The method of claim 1 wherein said temperature is above 615° F.

3. The method of claim 1 wherein only the part of the process where the oil that has the greatest residence time in the temperature range of 450–615° F. is raised above 615° F.

4. The method of claim 1 wherein only the part of the process where the oil that has the greatest residence time in the temperature range of 500–580° F. is raised above 580° F.

5. The method of claim 1 wherein all the parts of the process where the oil that has residence times greater than 30 seconds in the temperature range of 450–615° F. is raised above 615° F.

6. The method of claim 1 wherein all the parts of the process where the oil that has residence times greater than 30 seconds in the temperature range of 500–580° F. is raised above 580° F.

7. The method of claim 1 wherein all the parts of the process where the oil that has residence times greater than 1 minute in the temperature range of 450–615° F. is raised above 615° F.

8. The method of claim 1 wherein all the parts of the process where the oil that has residence times greater than 1 minute in the temperature range of 500–580° F. is raised above 580° F.

9. A method for mitigating the fouling of process equipment by dienes and conjugated olefins thermally cracked petroleum oils with diene values by UOP method number 326-82 of 4 grams iodine/100 grams oil or greater comprising reducing the residence time of the petroleum oil in the temperature range of 450–615° F. to less than 30 seconds thereby reducing polymerization of said dienes and conjugated olefins.

10. The method of claim 9 where the residence time of the petroleum oil in the temperature range of 500–580° F. is reduced to less than 30 seconds.

11. The method of claim 9 where the residence time of the petroleum oil in the temperature range of 450–615° F. is reduced to less than 1 minute.

12. The method of claim 9 where the residence time of the petroleum oil in the temperature range of 500–580° F. is reduced to less than 1 minute.

13. The method of claim 9 in which the residence time is decreased by increasing the flow rate.

14. The method of claim 9 in which the residence time is decreased by redesigning the process equipment to minimize dead zones.

15. The method of claims 1 or 9 in which the process equipment is a fractionator after a flexicoking unit, after a Fluid Coking unit, or after a delayed coking unit.

16. The method of claims 1 or 9 in which the process equipment is a reboiler.

17. The method of claims 1 or 9 in which the process equipment is a heat exchanger.

18. The method of claims 1 or 9 in which the process equipment is a hydrotreater reactor.

19. The method of claims 1 or 9 in which the process equipment is a fractionator after a visbreaker or a gas oil thermal cracker.

* * * * *